US005423662A

United States Patent [19]

Hetherington

[11] Patent Number: 5,423,662

[45] Date of Patent: Jun. 13, 1995

[54] PRECISION METERED MULTIPLE FLUID PUMPING SYSTEM

[75] Inventor: Robert D. Hetherington, Sunland, Calif.

[73] Assignee: Binks Manufacturing Company, Franklin Park, Ill.

[21] Appl. No.: 52,405

[22] Filed: Apr. 22, 1993

[51] Int. Cl.[6] ..... F04B 23/06

[52] U.S. Cl. ..... 417/429; 417/530

[58] Field of Search ..... 417/429, 426, 530; 192/52

[56] References Cited

U.S. PATENT DOCUMENTS

| | | | |
|---|---|---|---|
| 1,318,718 | 10/1919 | Belk | 417/429 |
| 2,071,778 | 2/1937 | Walne | 417/429 |
| 3,279,376 | 10/1966 | Hart | 417/429 |
| 4,273,261 | 6/1981 | Krueger | 417/429 X |
| 4,312,463 | 1/1982 | Daby | 417/429 X |
| 4,349,321 | 9/1982 | Bentley | 417/429 X |
| 4,509,903 | 4/1985 | Fram | 417/429 X |
| 5,094,596 | 3/1992 | Erwin et al. | 417/397 |

*Primary Examiner*—Richard E. Gluck

*Attorney, Agent, or Firm*—David O'Reilly

[57] ABSTRACT

A precision metering, multiple fluid pumping system comprised of a main pump for pumping a primary fluid and an auxiliary pump for pumping a secondary fluid adjustably linked to work in unison with the main pump. The auxiliary pump is linked to the main pump through a rack and pinion gear system connected to an oscillating arm that operates the auxiliary pump simultaneously with the main pump. The auxiliary pump is infinitely adjustable over a selected range by varying the connecting point of the auxiliary pump to the oscillating arm. The connecting point is varied by a worm screw adjustment that provides precision adjustment and metering of a secondary fluid. The system also includes a clutch mechanism between the auxiliary pump oscillating arm and a rack and pinion gear system to disengage the auxiliary pump for priming. An additional feature is the inclusion of a leak detection system in the form of a drain conduit connected to a clear container that visibly indicates when seals in the auxiliary pump may be leaking. When fluid leaks past a main seal in the auxiliary pump, it is collected in the clear container visibly indicating the seals need replacement.

22 Claims, 6 Drawing Sheets

PRECISION METERED MULTIPLE FLUID PUMPING SYSTEM

SPECIFICATION

1. Field of the Invention

This invention relates to multiple fluid pumping systems for precisely metering multiple fluids and more particularly relates to a precision metering system for a multiple fluid pumping system having a main pump for pumping a primary fluid that works in unison with one or more precisely adjustable auxiliary pumps for precisely metering the flow of one or more secondary fluids.

2. Background of the Invention

Pumps are available that pump multiple fluids that are delivered in metered amount for precise mixing. Pumps that deliver a resin that receive a metered amount of catalyst are of this type. They are often in pumping systems that have a main and auxiliary pump in a master/slave arrangement. Precise metering of the amount of catalyst for mixing with the resin is necessary.

Precision metering is important for manufacturing of quality products. In the fiberglass reinforced product (FRP) industry the proper ratio of catalyst to resin is essential to proper curing of the finished product. This ratio is not fixed, however. Temperature, humidity and product variations can change the rate needed to achieve the desired result. Thus the changes needed in the ratio require adjustments over a predetermined range to allow for varying conditions as well as variations in the product itself. Adjusting the ratio while maintaining the precision metering needed is a prime objective.

One such metered proportional pumping system is shown and described in U.S. Pat. No. 3,650,434 of Johnson et al issued Mar. 21, 1972. This patent describes a metered primary fluid and a wobble plate that changes the stroke of pistons to vary the output of secondary fluid. A manual control varies the tilt of the wobble plate to vary the proportion of secondary fluid to primary fluid. While this device is effective it is complicated in construction and requires numerous parts. Also if any one of the pistons fail for any reason the ratio of secondary fluid to primary fluid will be immediately significantly affected and can cause damage to the product.

Other master/slave pump systems arrangements presently available have a small volume pump linked to the main pump by a long arm in a teeter-totter arrangement. Adjustments are made by mechanically disconnecting and re-attaching the auxiliary pump drive arm to the linking arm. This varies the mechanical linkage to shorten or lengthen the pumping link arm. This is not very precise or convenient. The link arm is provided with a series of holes for bolting the slave pump to operate in conjunction with the master pump. The slave pump is disconnected and rebolted at a selected position on the link arm to vary the slave pump stroke and adjust the output. However the adjustment then becomes incremental and not very precise.

Priming the auxiliary pump is also not convenient. The slave pump must be disconnected from the link arm and the stroke arm operated manually. This can also be hazardous as toxic materials have sometimes been sprayed on the operator.

The manual priming problem is particularly acute where toxic or hazardous materials are being pumped.

Leaks have caused operators to be squirted with hazardous, toxic materials. This can be particularly dangerous if the operator or employee is squirted in the eyes with any of these hazardous materials.

The imprecise adjustment of the ratio of secondary fluid to primary fluid makes it difficult to determine the percentage of auxiliary fluid being delivered. It can then become a trial and error method to get the correct mixture, which results in waste of materials and is only approximate. This is because most present adjustment methods are not continuously adjusted over a selected range but has a number of incremental adjustments.

The present systems also use gravity feed to couple a single slave pump for spraying of primary and secondary fluids. This means that fluid must be poured in a reservoir for gravity flow and can result in contamination of the fluid. Thus the present system can only couple a single slave pump to pump a single secondary fluid with a primary fluid from a main pump.

It is one object of the present invention to provide a multiple fluid pumping system for primary and auxiliary fluids that have accurate, precise metering.

Another object of the present invention is to provide a continuously variable metering system for a multiple fluid pumping system.

Still another object of the present invention is to provide a precision metering system for pumping a secondary fluid in unison with a primary fluid that allow accurate prediction of the percentage of secondary fluid delivered.

Yet another object of the present invention is to provide a precision metered multiple fluid pumping system for multiple fluids in which the slave pump is directly driven from the main pump drive shaft providing continuous pumping of the secondary fluid without any free play or backlash.

Another object of the present invention is to provide a multiple fluid pumping system that pumps primary and secondary fluids that allows rapid, accurate adjustment of the delivery of the secondary fluid.

Still another object of the present invention is to provide a master/slave multiple fluid pumping system that allows the slave pump to be easily disengaged for priming either pump independent of the other.

Yet another object of the present invention is to provide a master/slave multiple fluid pumping system that permits pumping of a secondary fluid directly from the shipping container by suction feeding.

Another object of the present invention is to provide a master/slave multiple fluid pumping system that provides leak protection.

Yet another object of the present invention is to provide a master/slave multiple fluid pumping system that provides leak detection to indicate when seals need repair or replacement.

Another object of the present invention is to permit pumping of multiple secondary fluids from a master/slave multiple fluid pumping system.

BRIEF DESCRIPTION OF THE INVENTION

The purpose of the present invention is to provide a multiple fluid pumping system having a main and secondary auxiliary pumps that works in unison to provide precise metering of a secondary fluid for delivery with a primary fluid. The system provides accurate, infinite adjustment and is safe and easy to adjust and use.

The master/slave multiple fluid pumping system of the present invention provides an auxiliary pump coupled directly to the drive shaft of a main pump through a rack and pinion gear system that allows accurate adjustment and metering of a secondary fluid. The auxiliary pump is linked to the main pump by a ball joint attached to the yoke of an oscillating quadrant arm that is coupled to a pinion gear shaft. The pinion gear on the pinion gear shaft engages a gear rack mounted on the main pump drive shaft. As the main pump reciprocates, the gear rack reciprocates rotating the pinion gear and shaft which in turn rotates the oscillating arm through a predetermined quadrant or arc. The amount of secondary or auxiliary fluid delivered is adjusted by adjusting the working length of the oscillating arm. That is, by varying the auxiliary or slave pump piston rod connecting position with respect to the pinion gear shaft center line or axis.

The end of the slave pump drive shaft is connected to a manually adjustable screw drive in the oscillating arm yoke that allows continuous infinite adjustment from one end to the other end of the calibrated screw drive. Preferably the adjustment is set to vary the ratio of secondary or auxiliary fluid from one half percent up to about five percent of the primary fluid. When the auxiliary pump shaft is adjusted to a point nearest the axis of rotation of the oscillating arm, the amount of auxiliary fluid delivered is least or about one half percent (0.5%) of the main or primary fluid. Rotation of the oscillating arm drive screw adjusts the position of the auxiliary pump connection for continuous variation to the farthest outer end at which point the maximum secondary fluid will be delivered. The maximum auxiliary or secondary fluid is preferably adjustable to about three and one half percent (3.5%). The adjustment system allows extremely small precise adjustments in the range of secondary fluid delivered.

Preferably the main pump is a high pressure piston pump such as that disclosed and described in U.S. Pat. No. 5,094,596. In this pump the pumping system is comprised of a pair of opposed single acting piston pumps operated alternately by an interposed reciprocal actuator. Each pump of the opposed single acting pumps has an aligned inlet and outlet check valves defining a straight line fluid path diametrically through a pumping chamber. The piston pumps have a relatively short stroke to maintain the straight line path of flow through the pumping chamber. The output from each side of the reciprocating piston pumps are connected to a manifold for delivery to a spraying system or other fluid dispensing device or system.

The opposed single acting piston pump of the patent referred to hereinabove is particularly useful for pumping resins for delivery to a spraying system in combination with an initiator such as a catalyst. The system may also be used with multiple pumps for pumping any fluid that need initiators, accelerators or even to add pigments. The system can be used for pumping resin with a catalyst and perhaps several other fluids such as different initiators. It also can be used for pumping with hybrid resins. The system would also be suitable for delivering with an initiator with paints having chemistry that require initiator.

The connection of the auxiliary pump to the primary pump eliminates free play when the primary pump reverses maintaining an accurate flow of the secondary fluid. The auxiliary pump is linked to the main pump to work in unison through an oscillating arm having a drive screw connected to the auxiliary pump drive shaft. The relative length of the oscillating arm is varied by adjusting the position at which the auxiliary drive pump is connected. A knob on the end of the oscillating arm drive screw allows rotation of the drive screw to vary the position at which the auxiliary pump drive shaft is connected. Rotation clockwise shortens the relative length of the oscillating arm while counterclockwise rotation lengthens it. The longer the stroke caused by the adjustment the greater the amount of secondary fluid is delivered.

The connection between the auxiliary pump and the drive screw of the oscillating arm includes a percentage scale having a pointer that indicates on a scale the percentage of secondary fluid being delivered. The scale is imprinted on the upper surface of the oscillating arm indicating a percentage of secondary fluid from 0.5% up to 3½% by volume of the primary fluid.

The adjustable oscillating arm is connected to the primary pump through a rack and pinion gear and a clutch coupling mechanism that allows the auxiliary pump to be disengaged for priming. The gear rack is attached to the drive shaft of the primary pump for reciprocation therewith. The gear rack is mounted in a floating carrier block securely retained on the primary pump piston rod. The gear rack carrier block floats on the pump piston rod but is retained in a manner that prevents free play but allows for rotation of the piston rod while maintaining engagement with the pinion gear. The gear rack is spring loaded to be self-adjusting to eliminate free play as the drive shaft cycles. Thus when the drive shaft of the primary pump reverses, the spring loaded gear rack prevents any backlash.

A clutch coupling mechanism connecting the oscillating arm to the pinion gear shaft is comprised of a clutch plate mounted on the end of the pinion gear shaft for engaging a clutch block attached to the oscillating arm. The clutch block has clutch pins engaging sockets in the clutch plate securely fastened to the pinion gear shaft. Grooves in the outer end of the pinion gear shaft provide detents for engaging and disengaging the clutch block and oscillating arm from the pinion gear clutch plate. This allows either pump to be primed before operating the system. The auxiliary pump can be easily manually primed by rotating the oscillating arm or the primary pump can be primed by operating alone. To disengage the oscillating arm an outward axial force causes a spring loaded ball to move from the engaged detent to the disengaged detent disconnecting the oscillating arm from the pinion gear. The oscillating arm and shaft of the auxiliary pump or primary pump can then be operated separately to prime the pumping system.

As described previously the pump is preferably a pair of opposed acting piston pumps operated alternately by a reciprocal actuator. This arrangement allows up to four auxiliary pumps to be driven by the multiple fluid pumping system. The pinion gear is mounted on a shaft that passes through the housing of the main pump and is supported by sealed bearings on each side. The pinion gear shaft can be extended beyond both sides of the primary pump housing allowing an auxiliary pump to be connected on either side. Further since the primary pump is a dual in-line single piston pump an additional pair of auxiliary pumps could be mounted on the other side. Thus up to four auxiliary pumps could be included in the system.

The secondary pumping system also includes a leak indicating system to provide protection against the release of the auxiliary fluids which in some cases can be hazardous and toxic. This system includes a pair of seals on the auxiliary pump shaft. The first or inner seal is the main seal with a secondary seal being at the outermost end of the housing. Between the seals a leak manifold is provided connected to a hose terminating in a transparent or translucent container. Since the main seal is subjected to most of the pressure it will be the first to begin leaking allowing secondary fluid from the auxiliary pump to flow into the leak manifold through the hose and into the translucent leak container. Any flow of the secondary fluid into the translucent container indicates that the main seal is defective requiring repair or replacement of the seals. The leak detecting system thus provides a notice of maintenance of the pumping system.

The system also permits the pumping of secondary fluids directly from shipping containers. The auxiliary pump delivers the fluid directly from the shipping container by suction. A visible flow meter confirms the proper adjustment and flow of fluid through the auxiliary pumping system. The adjustment knob on the oscillating arm yoke adjusts the flow according to a scale on the arm which can be confirmed by the visible flow meter.

The above and other features of this invention will be fully understood from the following detailed description and the accompanying drawings, in which:

DETAILED DESCRIPTION OF THE INVENTION.

Figure 2:
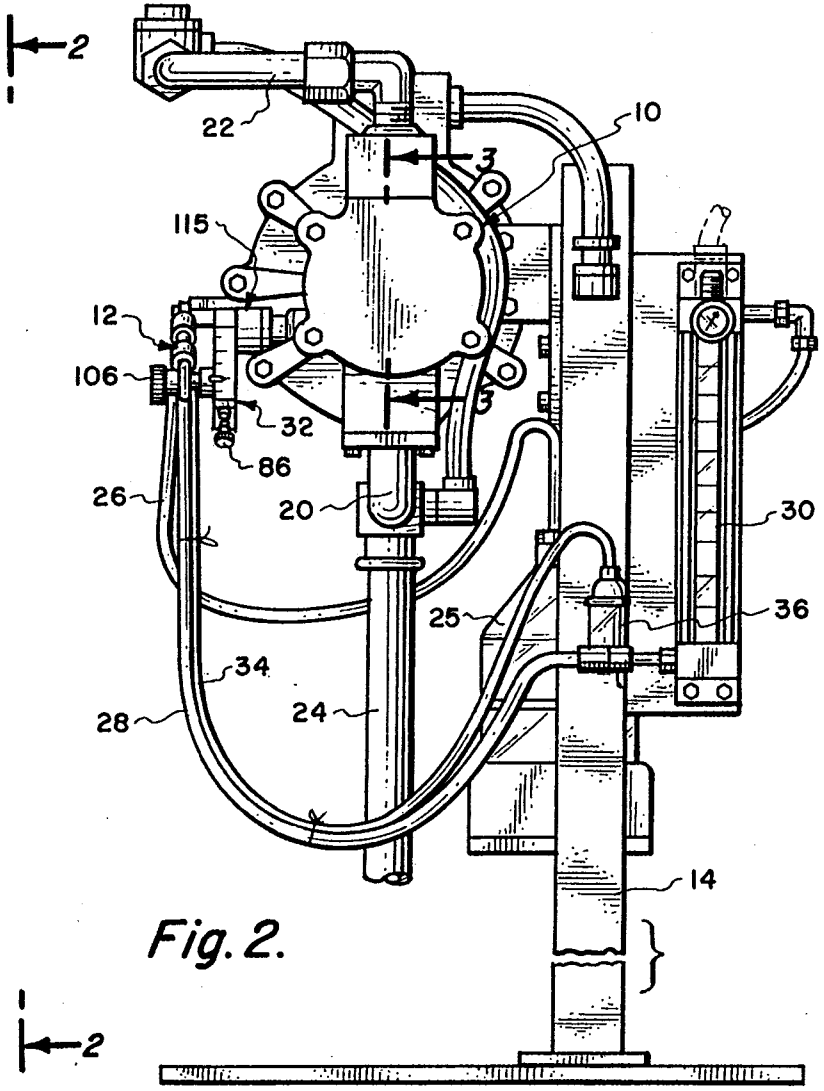
FIG. 2 is a side elevation of the multiple fluid pumping system of FIG. 1 taken at 2—2 of FIG. 1.
Figure 1:
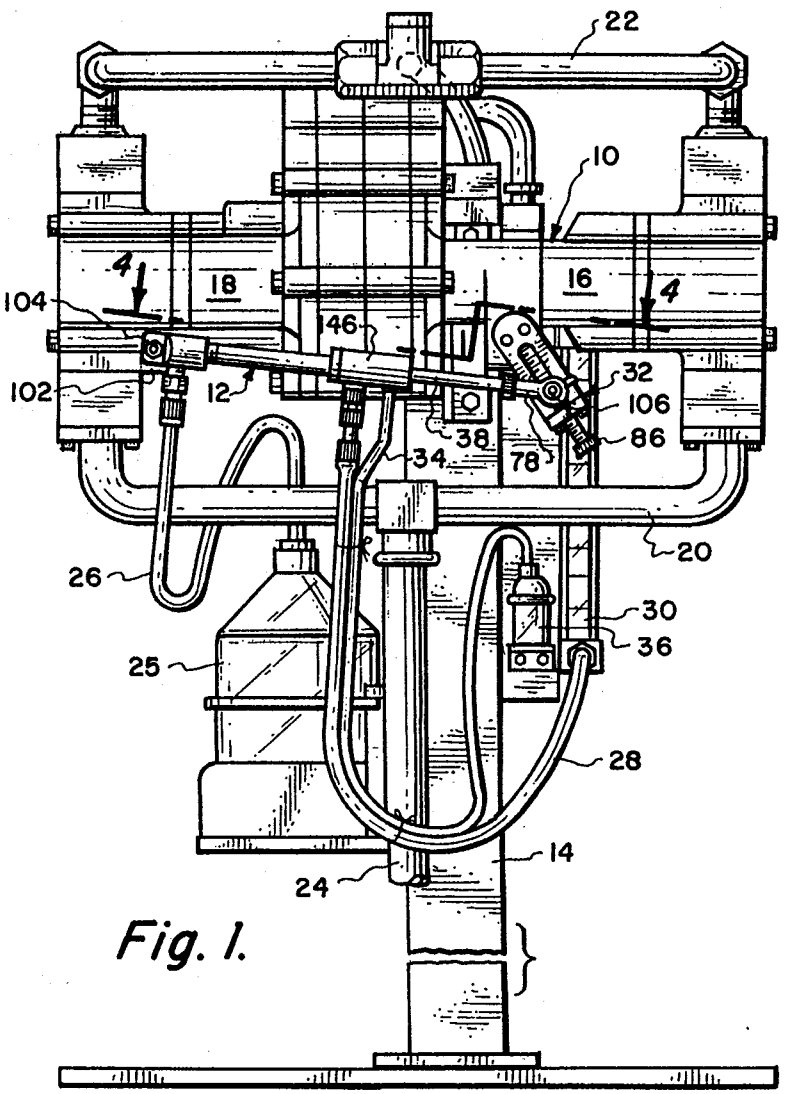
FIG. 1 is a front view of a multiple fluid pumping system in which a secondary fluid is precisely metered for combination with a primary fluid.

A precision metering multiple fluid pumping system is shown generally in FIGS. 1 and 2. The precision metering multiple fluid pumping system is comprised of a main pump 10 working in unison with an auxiliary pump 12 mounted on a stand 14. Preferably main pump 10 is an opposed single acting dual piston pump such as that disclosed in U.S. Pat. No. 5,094,596 referred to hereinabove but could be provided by a variety of piston pumps. Main pump 10 is comprised of a pair of pumps 16 and 18 that are connected by manifolds 20 and 22 to pump a single fluent material. Material is supplied through supply conduit 24 to intake manifold 20 for delivery through pump 16 and 18 to outlet manifold 22. Outlet manifold 22 is then connected to spray equipment through hoses (not shown).

As an alternative pump 16 and 18 could be connected to pump two separate materials and each have an auxiliary pump 12 working in unison to supply a secondary fluid. Thus a variety of configurations could be provided as will be described hereinafter.

Auxiliary pump 12 is a double acting piston pump drawing material from a container 25 for delivery through supply conduit 26 which is then pumped through outlet conduit 28 and flow meter 30 for delivery to the spraying equipment or other fluid dispensing devices with the primary fluid from main pump 10. A precise controlled metered amount of secondary fluid from auxiliary pump 12 is controlled by adjusting the connection of the auxiliary pump 12 to oscillating arm 32 as will be described in greater detail hereinafter.

Because auxiliary pump 12 frequently pumps a toxic material, a leak detection system has been provided. The leak detection system is comprised of a drain conduit 34 connected to auxiliary pump 12 and translucent or transparent container 36 for collecting any secondary fluid leaking past seals in the auxiliary pump. When secondary fluid collected in container 36 is visible it indicates that the main seal in auxiliary pump 12 is leaking and the seals need to be replaced.

The delivery of secondary fluid from auxiliary pump 12 is controlled by adjusting the length of the pump stroke. This is accomplished by varying the connection of auxiliary pump piston rod 38 to oscillating arm 32. The position of the connection is adjusted by rotating knob 86 to vary the position of the connection thus varying the stroke of piston rod 38, as will be described in greater detail hereinafter.

Figure 3:
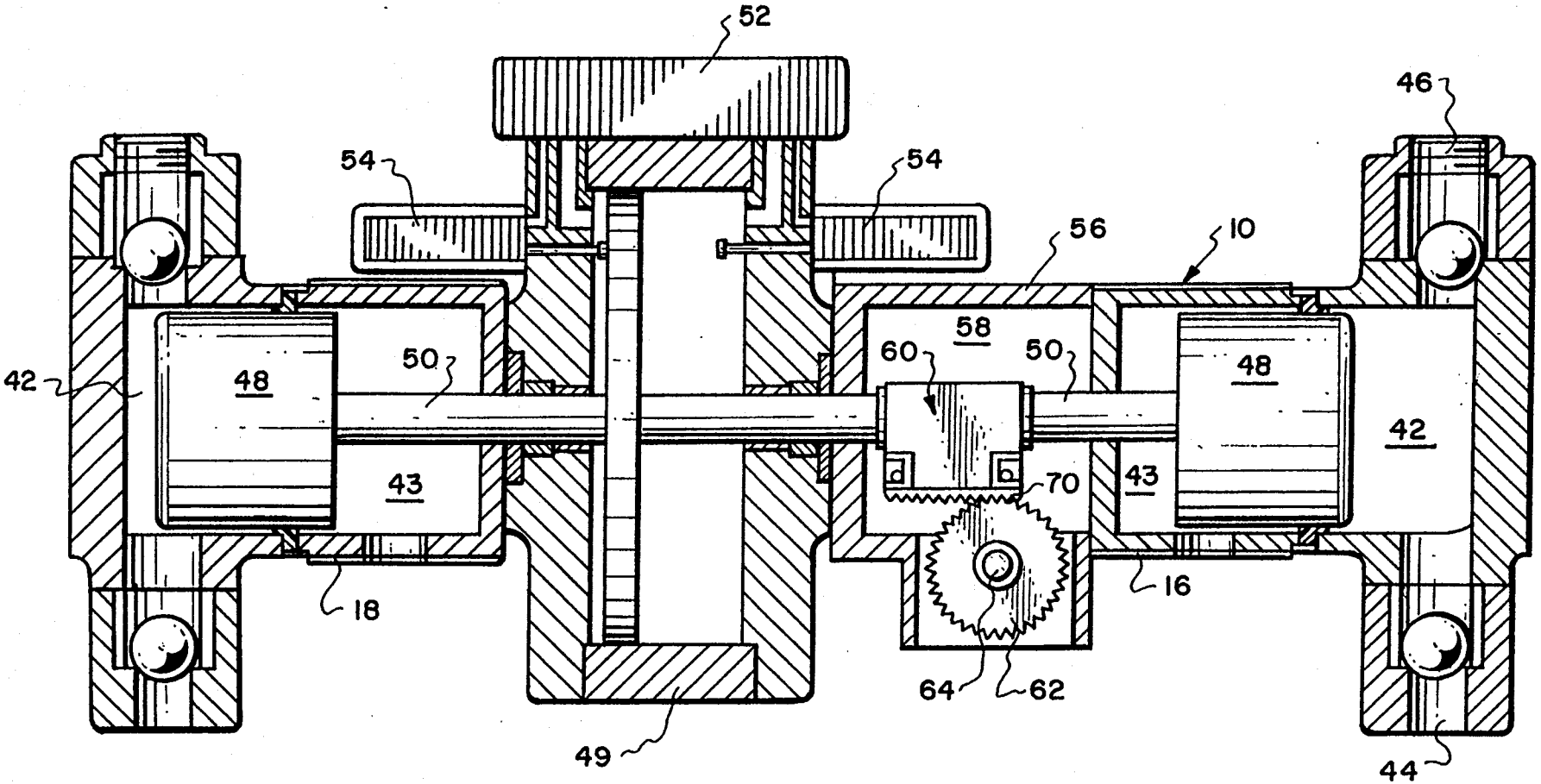
FIG. 3 is a sectional view of the primary pumping system taken at 3—3 of FIG. 2.
Figures 7, 8:
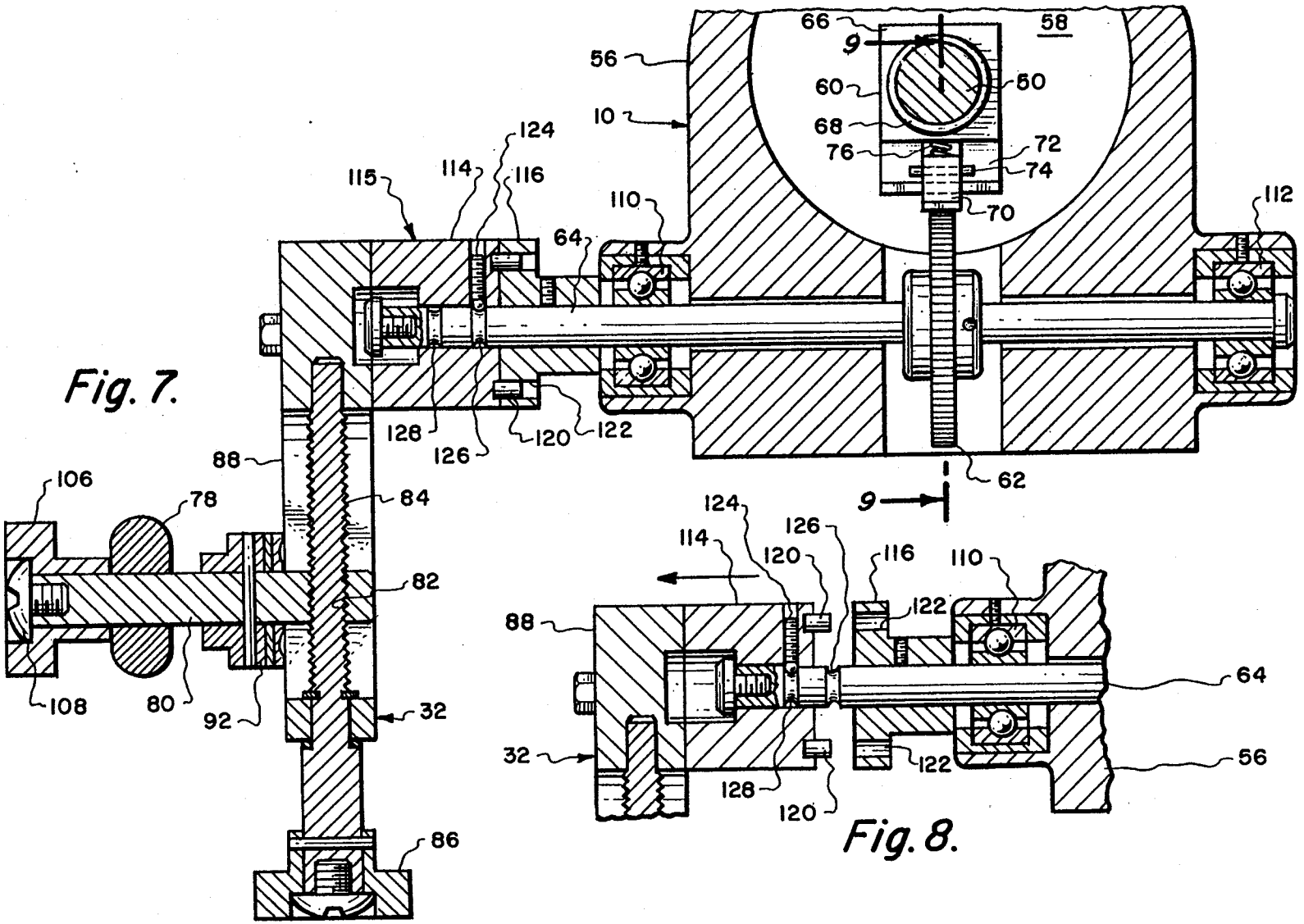
FIG. 7 is a sectional view of the auxiliary pump drive system taken at 7—7 of FIG. 6.
FIG. 8 is a partial sectional view illustrating the disengagement of the auxiliary pumping system.

Auxiliary pump 12 is connected to work in unison with main pump 10 through a rack and pinion gear system that operates oscillating arm 32 as shown in FIG. 7. Main pump 10 is essentially the same as that shown in the above identified patent incorporated herein by reference. Main pump 10 has pumping chambers 42 (FIG. 3) for pumping a primary fluid supplied at inlet 44 through outlet 46 to manifold 22 (FIG. 1). Air driven actuator 48 drives pumps 16 and 18 on opposite sides of the actuator. Except for the addition of the rack and pinion gear the pumps are substantially identical. They both have pumping chambers 42 and static chambers 43 and a piston 48 reciprocating in the pump by piston rods 50 that are driven by air motor actuator 49. Air is supplied to air motor actuator 49 through air control valve 52 and pilot valves 54.

To accommodate the rack and pinion gear, a static chamber extension 56 is added between pump 16 and air motor actuator 49 providing an additional static chamber 58. A drive system for auxiliary pump 12 is provided by floating gear rack carrier assembly 60 securely retained on pump piston rod 50 for reciprocation therewith. Gear rack 70 on floating gear rack carrier assembly 60 engages pinion gear 62 having pinion gear shaft 64. Reciprocation of piston rod 50 causes gear rack carrier assembly 60 to reciprocate, rotating pinion gear 62 through approximately one quadrant or a quarter of a turn.

Figure 9:
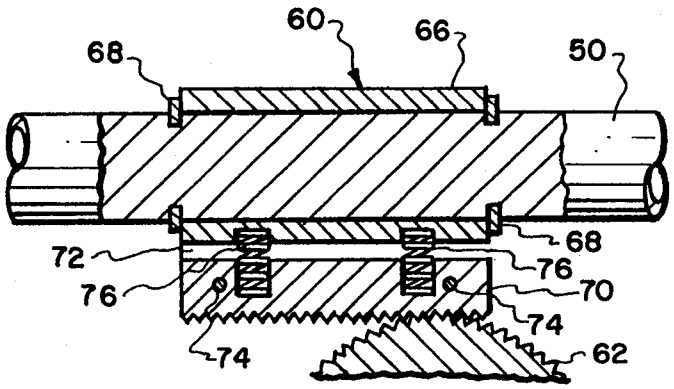
FIG. 9 is a sectional view taken at 9—9 of FIG. 7.

The connection of the rack and pinion gear to piston rod 50 is shown in greater detail in FIGS. 7 and 9. To prevent backlash, gear rack 70 is mounted on carrier block 66 so that it floats on piston rod 50 but is retained by C-rings 68. Carrier block 66 is allowed to float so it can reciprocate but not rotate with piston rod 50 keeping gear rack 70 in engagement with pinion gear 62. Gear rack 70 is mounted in channel 72 in gear rack block 66 and secured by pins 74. Coil springs 76 behind gear rack 70 allow the gear rack to self adjust to prevent free play and remove backlash when reciprocating piston rod 50 changes directions.

Figures 4, 6, 10:
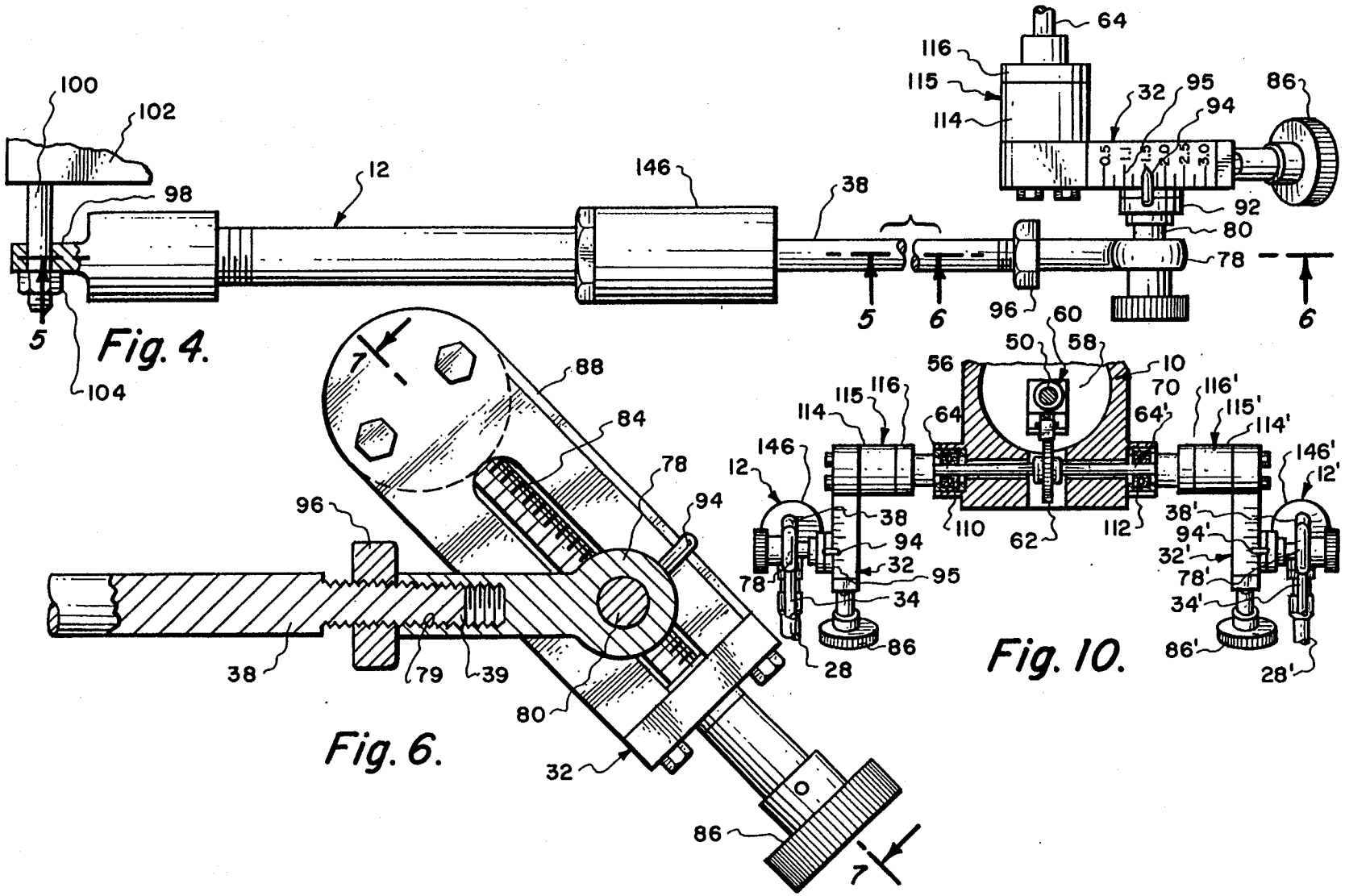
FIG. 4 is a top view of the auxiliary pumping system taken at 4—4 of FIG. 1.
FIG. 6 is a partial section of the auxiliary pumping system taken at 6—6 of FIG. 4.
FIG. 10 is a sectional view similar to FIG. 7 illustrating the connection of multiple auxiliary pumps to the main pump.

The connection of rack and pinion gear to auxiliary pump 12 is illustrated in FIG. 6 and 7. Reciprocating gear rack carrier assembly 60 rotates pinion gear 62 and pinion gear drive shaft 64. Oscillating arm 32 is connected to pinion gear drive shaft 64 for rotation therewith. Each rotation of pinion gear 62 thus rotates oscillating arm 32 through a corresponding arc or quadrant.

Auxiliary pump piston rod 38 is connected to oscillating arm 32 by rod end 78 attached to shaft 80 that has a threaded hole 82 engaging adjustable drive or worm screw 84. Worm screw 84 is rotated by knob 86 to adjust the connecting position of auxiliary pump piston rod 38. Thus the stroke length of auxiliary pump piston rod 38, is varied by adjusting the connected point between auxiliary pump piston rod 38 and oscillating arm 32 with knob 86. Worm screw 84 is mounted in a yoke 88 secured to pinion gear drive shaft 64 through a clutch system which will be described in greater detail hereinafter. The amount of material delivered by auxiliary pump 12 is shown by the position of pointer 94 on carrier block 92 mounted on adjustable sliding shaft 80 indicating the percentage of secondary fluid on scale 95 being delivered by the multiple fluid pumping system. The range of scale 95 is preferably 0.5% to 3.5%.

The length of the stroke of auxiliary pump 12 is determined by piston rod 38 and its connection to oscillating arm 32. Threads 39 on the end of piston rod 38 engage similar threads 79 in rod end 78 to secure the piston rod to adjusting shaft 80. Lock nut 96 fixes the length of piston rod 38. Thereafter the length of auxiliary pump piston rod 38 remains constant and only the position of its connection to oscillating arm 32 is changed by adjusting knob 86.

Auxiliary pump 12 is mounted for easy replacement if desired, as shown in FIG. 4. The back end of auxiliary pump 12 has a boss 98 fitting on a pin 100 attached to the housing 102 of main pump 10. The back end of auxiliary pump 12 is secured by nut 104 threaded on pin 100. The forward end is connected as previously described by rod end 78 mounting on adjustable shaft 80 and secured by priming knob 106 and screw 108. Thus auxiliary pump 12 can be easily removed and replaced with another pump or a different size pump by removing nut 104 and knob 106.

The flow of secondary fluid when used in a resin-catalyst system is preferably varied between 0.5% to 3½% of the ratio to the amount of primary fluid. Thus the length of the stroke of the auxiliary pump 12 is changed by adjusting knob 86 so that pointer 94 indicates precisely on scale 95 the percentage of secondary fluid being delivered relative to the primary fluid. With adjusting shaft 80 farthest from the end of oscillating arm yoke 88 the minimum amount of catalyst or 0.5% will be delivered. Knob 86 can then be adjusted to increase the amount of secondary fluid to as much as 3½% as indicated by pointer 94 and scale 95 (FIG. 4) with adjusting shaft 80 closest to the end of oscillating arm yoke 88. As can be seen in FIG. 7, the arrangement of worm screw 84 and oscillating arm yoke 88 allows infinite continuous adjustment in the range selected and determined by the connection of auxiliary pump 12 and adjustment of worm screw 84.

With the arrangement shown, up to four auxiliary pumps working in unison with main pump 10 could be used. For example as shown in FIG. 7, pinion gear 62 is mounted on drive shaft 64 which extends through housing extension 56 and is supported by bearings 110 and 112. If pinion gear drive shaft 64 is extended beyond bearing 112 it is clear that a second auxiliary pump could be connected to the opposite side. FIG. 10 illustrates the connection of two auxiliary pumps 12 and 12' to main pump 10.

All the parts indicated by prime numbers connecting auxiliary pump 12' to main pump 10 are the same as the parts connecting auxiliary pump 12. Auxiliary pump 12' is connected to the piston rod 50 of main pump 10 by extending pinion gear shaft 64' through the other side of main pump 10.

Figure 11:
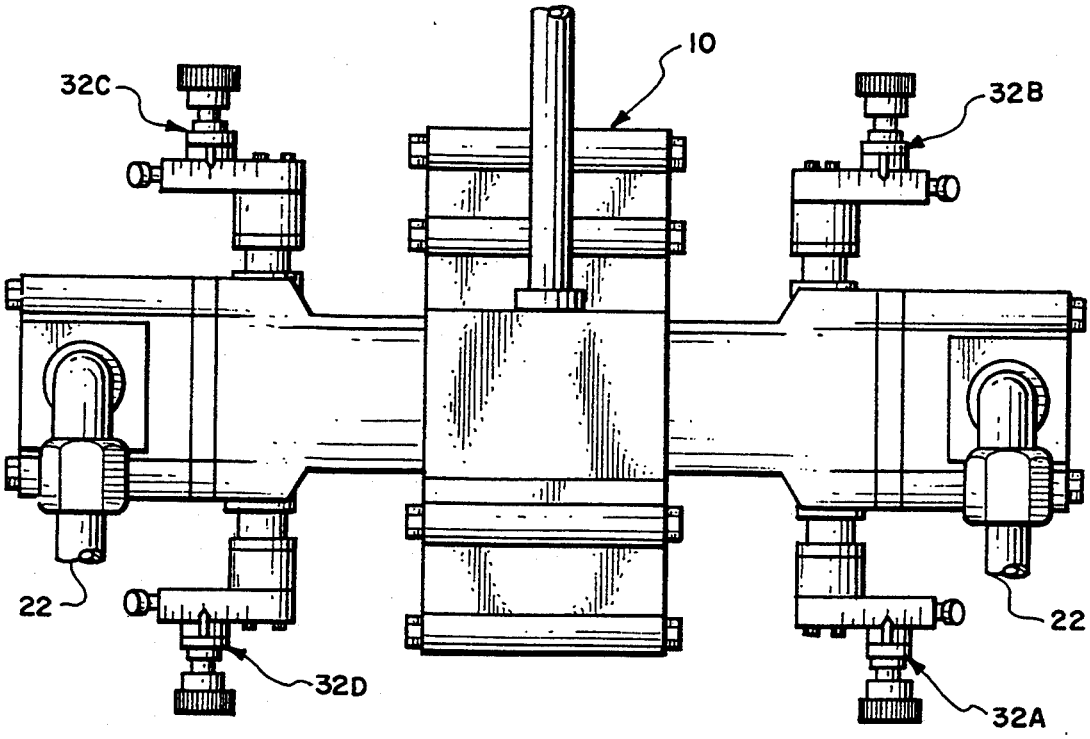
FIG. 11 is a top view of a multiple fluid pumping system illustrating four auxiliary pumps connected to the main pump.

Likewise pump 18 could include an additional extension housing 56 for the addition of two more auxiliary pumps as shown in FIG. 11. It also should be clear that auxiliary pumps 12 could be mounted vertically or horizontally or at any angle desired. FIG. 11 is a top view of main pump 10 having four auxiliary pumps 32A, 32B, 32C, 32D connected at each end as shown in FIG. 10. All that is needed is that the piston rod of each auxiliary pump be connected to oscillating arm 32 mounted on pinion gear drive shaft 64. Thus the position of oscillating arm 32 on pinion gear drive shaft 64 determines the relative position of auxiliary pump 12. With multiple auxiliary pumps connected as shown in FIGS. 10 and 11 each pump can deliver different fluids at different rates. Thus with the dual in-line main pump up to four auxiliary pumps can deliver four different fluids at different rates or can be disconnected to deliver no fluid at all.

Oscillating arm 32 is also connected to pinion gear drive shaft by a clutch mechanism 115 that allows all auxiliary pumps 12, 12' to be disengaged for priming by rotating oscillating arm 32 with priming knob 106. Clutch mechanism 115 is illustrated in FIG. 7 and 8. Oscillating arm yoke 88 is securely fastened to clutch block 114 and engages clutch plate 116. Clutch block 114 includes pins 120 that engage sockets 122 in clutch plate 116. The position of clutch block 114 and thus oscillating arm 32 on pinion gear drive shaft 64 is determined by self-contained, spring loaded ball mechanism 124. Pinion gear drive shaft 64 has a pair of annular detents 126 and 128 for locking oscillating arm 32 in an engaged and disengaged position as shown in FIG. 7.

When clutch block 114 is engaged with clutch plate 116, spring loaded ball 124 will be in first detent 126. To disengage the clutch mechanism an outward axial force is applied to oscillating arm 32 to move spring loaded ball mechanism 124 to detent 128. With clutch block 114 in the disengaged position illustrated in FIG. 8 auxiliary pump 12 can be easily primed manually by rotating oscillating arm 32 in a full circle with priming knob 106 on pinion gear drive shaft 64. Also with the auxiliary pump clutch mechanism disengaged main pump 10 can be primed by independent operation.

Figure 5:
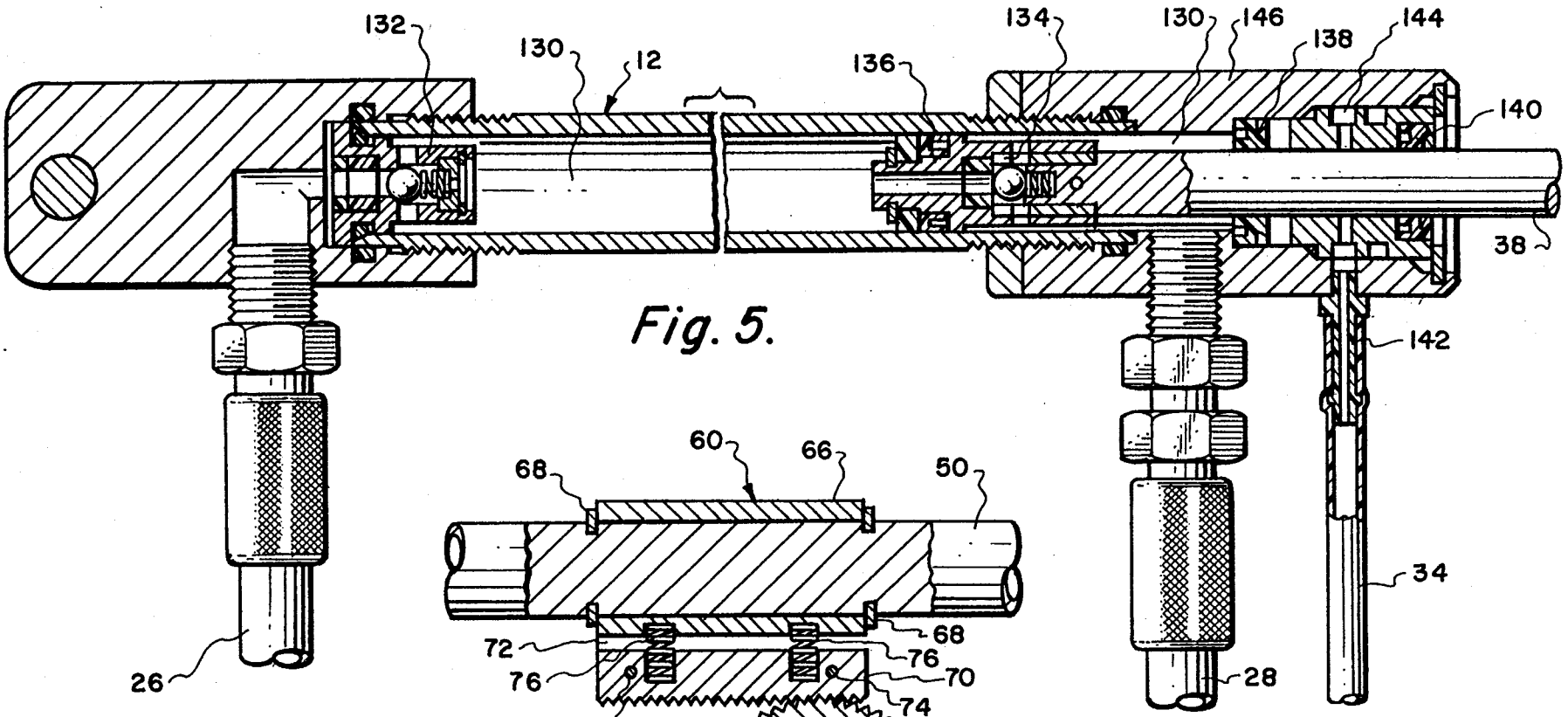
FIG. 5 is a sectional view of the auxiliary pumping system taken at 5—5 of FIG. 4.

Priming of auxiliary pump 12 can be hazardous if the seals in the pump leak allowing the toxic material to be sprayed on an operator. For this reason, a leak detection system is provided to indicate when seals need replacement. The leak detection is shown generally in FIG. 1 and is comprised of drain conduit 34 connected to a collecting container 36 that is transparent or translucent to visibly indicate that material is leaking past the seals in auxiliary pump 12. The details of the leak detecting system are shown in more detail in FIG. 5. Auxiliary pump 12 has inlet conduit 26 and outlet conduit 28 for pumping fluid received in pumping chamber 130. Material flows from inlet conduit 26 through check valve 132 through pumping chamber 130 and a second check valve 134 attached to pumping piston 136 on piston rod 38. Main seal 138 and secondary seal 140 prevent leakage of toxic material being pumped by auxiliary pump 12.

To provide an indication of when seals need replacing, drain conduit 34 is connected by nipple 142 to annulus 144 in housing 146 of auxiliary pump 12. Since main seal 138 will be the first to fail since it is subjected to the most pressure, any material leaking through to annulus 144 will flow through nipple 142 and drain conduit 34 to collecting container 36. Thus the possibility of the operator being sprayed by toxic material is substantially eliminated as the collection of any of the toxic material in container 36 will visibly indicate that the seals need to be replaced.

An advantage of the present system is that the auxiliary pump 12 can be used to siphon material directly from shipping container 24 and therefore does not need gravity feed as in prior systems. To operate the system oscillating arm 32 is disengaged from the rack and pinion gear system by pulling the oscillating arm axially outward to disengage clutch mechanism 115. Auxiliary pump 12 can then be primed by rotating oscillating arm 32 with primary knob 106 and observing flow meter 30. Flow meter 30 provides an additional indication confirming flow and the proper setting of pointer 94 on scale 95 for delivering the selected ratio of secondary fluid. It confirms flow to assure that the auxiliary pump 12 has been properly primed.

Oscillating arm 32 is then pushed axially inward so that clutch mechanism 115 re-engages. The pump may be operated with assurances that the proper ratio of secondary fluid to primary fluid will be delivered. Again flow of secondary fluid is confirmed by observing flow meter 30.

As was stated previously the pump preferably uses the dual in-line pump shown and described in the patent referred to hereinabove but can use any suitable piston pump. All that is needed is a piston rod for attachment of gear rack. The dual in-line pumps of the prior patent is preferably because up to four auxiliary pumps can be attached by appropriate configuration of the housing and extension of the pinion gear drive shaft 64 beyond both sides of the housing. Thus up to four different secondary fluids can be delivered with one or even two primary fluids. This system can be used for any fluid that requires an initiator including resins or paints that require such initiators.

Thus there has been described a multiple fluid precision pumping system in which an auxiliary pump works in unison with a main pump for precise metering of a secondary fluid. The auxiliary pump is infinitely adjustable over a pre-selected range to provide an accurate precise amount of secondary fluid in a predetermined ratio to a primary fluid from the main pump. The system also includes a clutch mechanism for disengaging the auxiliary pump for repair, replacement or for priming the system. Also the linking system includes a spring loaded or resiliently mounted gear rack that prevents free play or backlash during reciprocal operation of the pump. A leak detection system comprised of a translucent container connected by a drain conduit to the auxiliary pump indicates when seals need repair or replacement.

This invention is not to be limited by the embodiment shown in the drawings and described in the description which is given by way of example and not of limitation, but only in accordance with the scope of the appended claims.

What is claimed is:

1. A precision metering multiple fluid pumping system comprising;

main reciprocating pump means for pumping a primary fluid;

auxiliary pump means for pumping a secondary fluid;

connecting means connecting said auxiliary pump means directly to a piston rod of said main reciprocating pump means for operation in unison therewith, said connecting means comprising an oscillating arm attached to a piston rod of said auxiliary pump means, and gear means connecting said oscillating arm to said main reciprocating pump piston rod;

disengaging clutch means for temporarily disengaging said auxiliary pump oscillating arm from said gear means for priming said pumping system;

said connecting means including variable adjusting means for adjusting the ratio of secondary fluid to primary fluid pumped over a predetermined range;

whereby the amount of secondary fluid supplied may be precisely metered.

2. A precision metering multiple fluid pumping system comprising;

a reciprocating piston pump for pumping a primary fluid;

auxiliary pump means for pumping a secondary fluid;

an oscillating arm directly connecting said auxiliary pump to a gear on a piston rod of said reciprocating piston pump, each stroke of said reciprocating piston pump rotating said oscillating arm through a predetermined arc;

adjusting means for precise adjustment of the rotational arc of said oscillating means for precisely metering the secondary fluid pumped by said auxiliary pump means;

clutch means for temporarily disengaging said oscillating arm connected to said auxiliary pump means from said reciprocating piston pump for priming said pumping system;

whereby said secondary fluid pumped by said auxiliary pump means may be precisely metered.

3. The system according to claim 2 in which said clutch means comprises; a clutch plate mounted on a gear shaft of said gear means; a clutch block mounted on said oscillating arm; means for engaging and disengaging said clutch block from said clutch plate.

4. The system according to claim 3 in which said means for engaging and disengaging said clutch block from said clutch plate comprises socket means in said clutch plate; pin means on said clutch block; said clutch block with said oscillating arm being axially movable from a first position with said pin means engaging said socket means in said clutch plate to a second position with said pins disengaged from said socket means.

5. The system according to claim 4 including means for holding said clutch block with said oscillating arm in said first or second axial position.

6. The system according to claim 5 in which said holding means comprises; a pair of axially spaced annular detents in said gear shaft; said clutch block means with said oscillating arm being axially slidable from one of said annular detents to the other; and a spring loaded ball mechanism for holding said clutch block means in a selected annular detent.

7. The system according to claim 6 in which said reciprocating piston pump means comprises a pair of dual in-line piston pumps driven by a central actuator.

8. The system according to claim 6 in which said auxiliary pump means comprises a plurality of auxiliary pumps connected to said main pump.

9. The system according to claim 8 in which said plurality of auxiliary pumps are independently adjustable for delivering different fluids at different rates.

10. The system according to claim 9 in which said main pump is a dual in-line pump; said plurality of auxiliary pumps comprise up to four auxiliary pumps.

11. The system according to claim 8 in which said auxiliary pump means comprises a plurality of auxiliary pumps connected to said main pump.

12. The system according to claim 2 in which said auxiliary pump means comprises a plurality of auxiliary pumps connected to said main pump.

13. The system according to claim 12 in which said plurality of auxiliary pumps are independently adjustable for delivering different fluids at different rates.

14. The system according to claim 13 in which said main pump is a dual in-line pump; said plurality of auxiliary pumps comprise up to four auxiliary pumps.

15. The system according to claim 2 in which said clutch means comprises; a clutch plate mounted on a gear shaft of said gear means; a clutch block mounted on said oscillating arm; means for engaging and disengaging said clutch block from said clutch plate.

16. The system according to claim 15 in which said means for engaging and disengaging said clutch block from said clutch plate comprises socket means in said clutch plate; pin means on said clutch block; said clutch block with said oscillating arm being axially movable from a first position with said pin means engaging said socket means in said clutch plate to a second position with said pins disengaged from said socket means.

17. The system according to claim 38 including means for holding said clutch block with said oscillating arm in said first or second axial position.

18. The system according to claim 17 in said holding means comprises; a pair of axially spaced annular detents in said gear shaft; said clutch block means with said oscillating arm being axially slidable from one of said annular detents to the other; and a spring loaded ball mechanism for holding said block means in said annular detents.

19. The system according to claim 18 in which said auxiliary pump means comprises a plurality of auxiliary pumps connected to said main pump.

20. The system according to claim 19 in which said plurality of auxiliary pumps are independently adjustable for delivering different fluids at different rates.

21. The system according to claim 20 in which said main pump is a dual in-line pump; said plurality of auxiliary pumps comprise up to four auxiliary pumps.

22. The system according to claim 20 in which said auxiliary pump means comprises a plurality of auxiliary pumps connected to said main pump.

* * * * *